United States Patent [19]

Moor

[11] Patent Number: 5,020,828

[45] Date of Patent: Jun. 4, 1991

[54] HEAT-SEALED DIE CUT BINDER

[75] Inventor: Marc L. Moor, Dayton, Ohio

[73] Assignee: The Mead Corporation, Dayton, Ohio

[21] Appl. No.: 356,152

[22] Filed: May 24, 1989

[51] Int. Cl.[5] ..... B42D 3/00; B42D 3/08

[52] U.S. Cl. ..... 281/29; 156/292; 281/36; 281/37

[58] Field of Search ..... 156/252, 253, 292, 514; 281/29, 36, 37, 30, 31, 35

[56] References Cited

U.S. PATENT DOCUMENTS

| | | | |
|---|---|---|---|
| 2,088,672 | 8/1937 | Steinthal | 40/152 |
| 2,364,029 | 11/1944 | Ryan | 156/292 |
| 2,616,823 | 11/1952 | Weymouth | 156/252 |
| 2,726,941 | 12/1955 | Markus et al. | 156/292 |
| 2,801,115 | 7/1957 | Federbush et al. | 281/31 |
| 3,572,957 | 3/1971 | Strassberg | 281/29 |
| 3,758,358 | 9/1973 | Kuroda | 156/292 |
| 4,164,085 | 8/1979 | Steeb et al. | 40/152 |
| 4,315,642 | 2/1982 | Errichiello | 281/33 |
| 4,630,843 | 12/1986 | Willat | 281/30 |

*Primary Examiner*—Paul A. Bell

*Attorney, Agent, or Firm*—Biebel, French & Nauman

[57] ABSTRACT

A binder is provided having a cover featuring a three-dimensional design produced by depressing plastic cover sheets into an opening in an underlying cover panel. The cover sheets are heat sealed together around the perimeter of the cover panel and in the regional of the depression. A plurality of such openings may be provided, all so shaped and positioned as to avoid substantially impairing the structural integrity of the cover.

7 Claims, 2 Drawing Sheets

HEAT-SEALED DIE CUT BINDER

BACKGROUND OF INVENTION

The present invention relates generally to portfolios, binders and the like, and more particularly, to such a device having a heat-sealed die cut panel incorporated thereunto.

For years binders, portfolios, ring binders or the like have used vinyl or other plastic cover sheets. The cover sheets have been overlaid upon cover panels made of chipboard or stiff paperboard. The panels provide support for the binder as well as provide a protective outer shell. The terms "portfolio" and "binder" may be used interchangeably herein with the understanding that "binder" refers generically to hinged folders whether or not binder rings are provided. The conventional fabrication of binders includes the heat sealing of the cover sheets about the perimeter of the binder.

For aesthetic reasons, binders oftentimes are made from a brightly colored vinyl and feature various types of surface decoration. Such decoration appeals to the purchaser, especially purchasers of high school age, thereby enhancing sales of the product. There is a continuing demand for new and eye appealing cover panels having decorative features which do not compromise the utilitarian features thereof.

SUMMARY OF THE INVENTION

This invention provides a binder having a cover provided with a novel three-dimensional design. The three-dimensional effect is achieved by creating one or more openings in the interior of a cover panel and sealing inner and outer overlay sheets against each other in the region of the openings. The openings are sufficiently small and sufficiently far removed from the panel perimeter to avoid substantial reduction in the structural integrity of the cover. The cover sheets are depressed into the cover panel openings and preferably are fused together by heat sealing.

The depressed cover sheet areas preferably cooperate to form the above mentioned three-dimensional design. Preferably the openings in the cover panel are fabricated by die-cutting the cover panel. The binder also has a spine panel intermediate the front and rear covers, to which it is hingeably connected.

It is the primary object of the present invention to provide a novel, decorative binder.

Other objects and advantages of the invention will be apparent from the following description, the accompanying drawings and the appended claims.

DETAILED DESCRIPTION OF THE INVENTION

Figure 1:
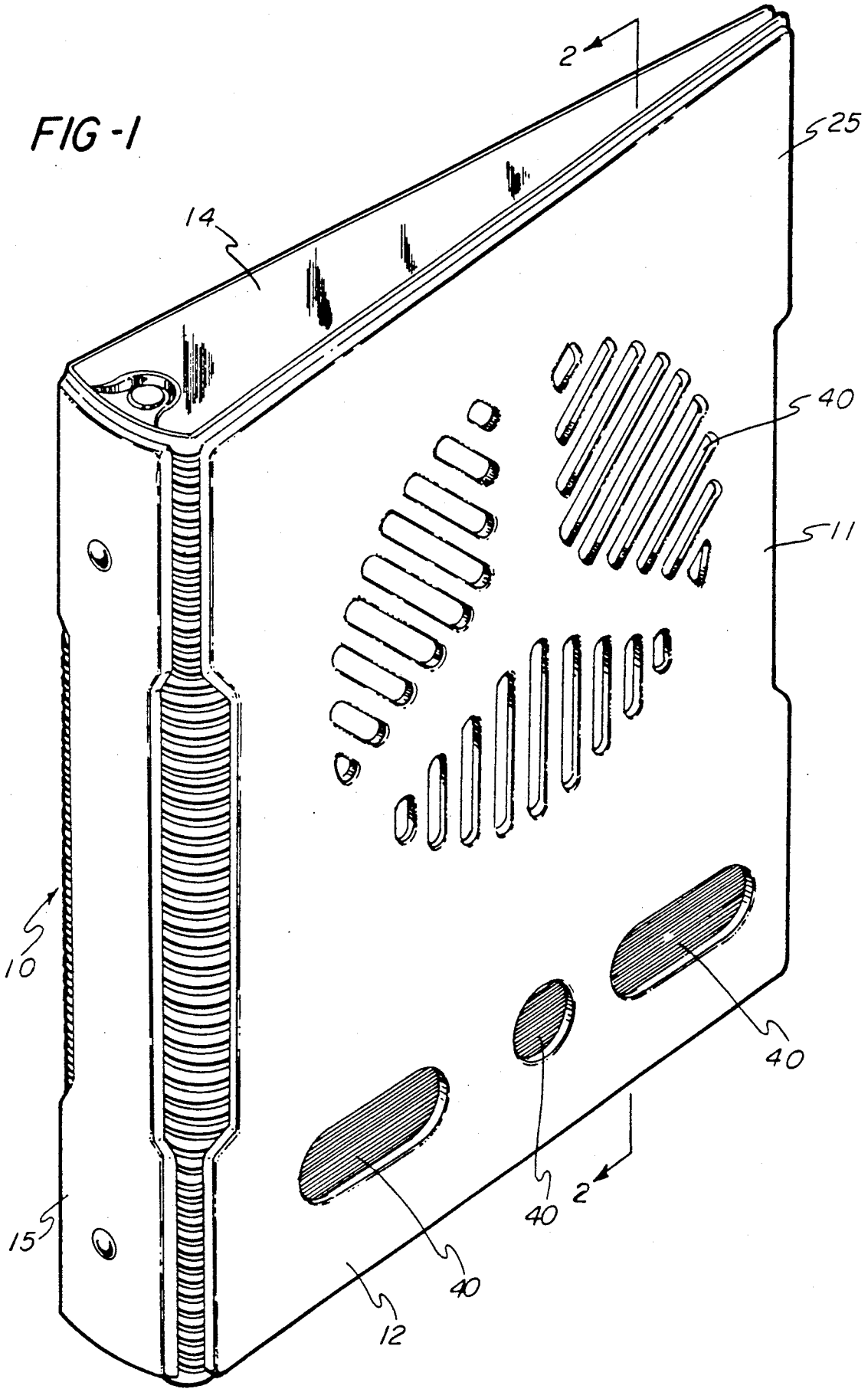
FIG. 1 is a perspective view of a binder in accordance with the present invention.
Figure 3:
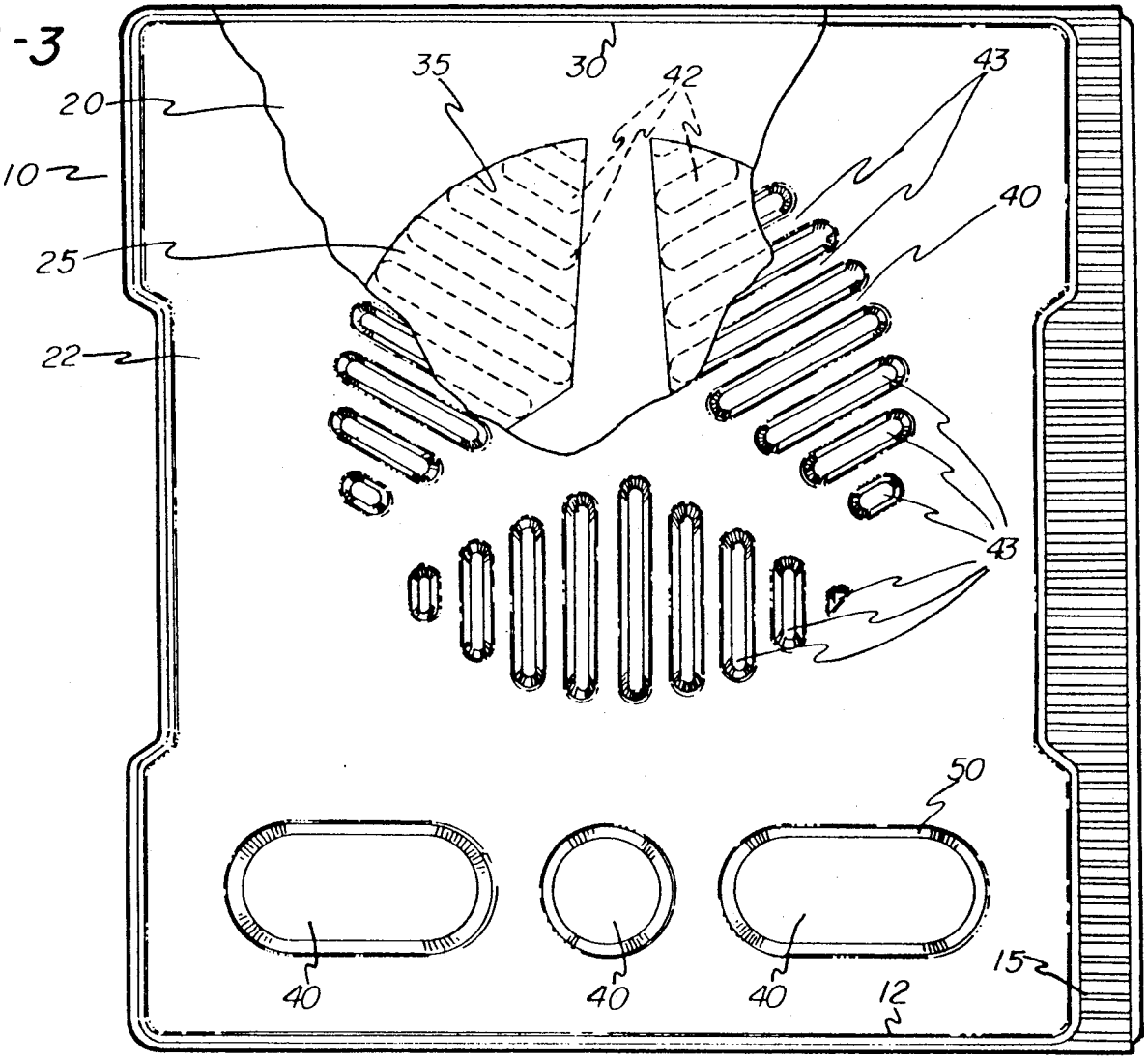
FIG. 3 is a partially cut-away plan view of a front cover.
Figure 2:
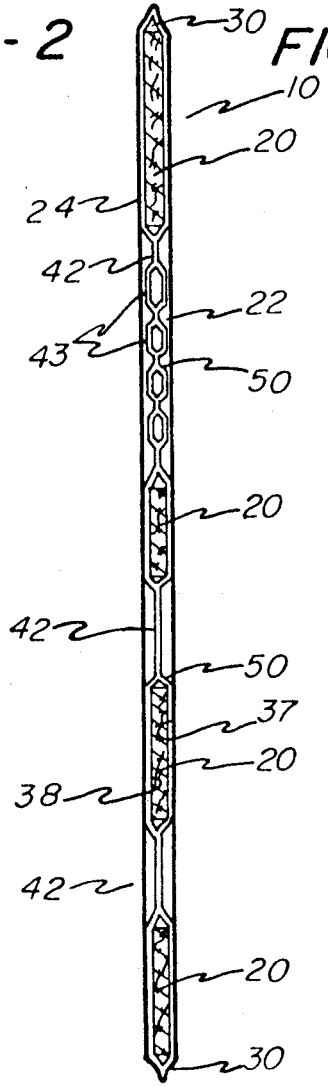
FIG. 2 is a vertical sectional view on an enlarged scale taken along line 2—2 of FIG. 1.

FIG. 1 is a perspective view of a heat-sealed die cut binder 10 in accordance with the present invention. Binder 10 comprises a front cover 12 and a rear cover 14 which, in the illustrative embodiment are hingedly connected with spine 15 being located intermediate front cover 12 and rear cover 14. As best shown in FIGS. 2 and 3, the covers comprise relatively stiff cover panels 20 which can be formed from paperboard or other appropriate material. While the cover panel of this invention is fabricated from a relatively stiff material, it is still somewhat flexible. An inner overlay sheet 22 overlays the interior surface of cover panel 20 while an outer overlay sheet 24 overlays the exterior of panel 20. Preferably these sheet-form layers are fabricated from a thermoplastic polymer such as polypropylene. The overlay sheets 22 and 24 are co-extensive with panels 20 and are joined together around the perimeter 30 of thereof. Preferably this joining occurs by fusing or heat-sealing.

Panel 20 has portions thereof removed by die cutting to form interior openings 35 of a size and location such that the structural integrity of the cover is not substantially impaired. Inner overlay sheet 22 has an inner surface 37 which is heat sealed to inner surface 38 of outer overlay sheet 24 in regions 42. Overlay sheet 22 and 24 are depressed into the openings 35 to accommodate such heat sealing, thereby defining depressions 40, and sloping regions 50.

The heat sealing of overlay sheets 22 and 24 in regions 42 defines slightly raised unsealed regions 43. The non-depressed regions of cover sheets 22 and 24, together with the fused and unfused regions of depressions 40 produce an attractive three-dimensional geometric design.

As noted above, openings 35 are of a size and location which do not substantially impair the structural integrity of the cover. Accordingly, they are sufficiently inward from perimeter 30 to avoid a weakened edge. Also they are sufficiently small in area to avoid a loss of twisting resistance. Thus the binder is durable as well as attractive.

In manufacturing the product embodying the invention, the cover panel 20 is cut to size and shape through the use of a heavy steel rule die at which time the openings 35 are cut from the area in the interior of the panel. The scrap may have to be removed by hand at the site of the production equipment by the equipment operator. The cut board is then loaded into conventional heat-sealing equipment for binders to await assembly and heat-sealing using conventional methods. The vinyl binder blank is heat-sealed through the use of machined brass die. Areas of the die align with the areas of openings 35 thus making it possible to heat-seal the interior and exterior sheet-form layers at the same time.

While the form of product herein described constitutes a preferred embodiment of this invention, it is to be understood that the invention is not limited to this precise form of product, and that changes may be made therein without departing from the scope of the invention which is defined in the appended claims.

What is claimed is:

1. A binder comprising relatively stiff front and rear hingedly connected covers, each of said covers comprising a cover panel, an inner cover sheet coextensive with and covering the inner surface of said cover panel, and an outer cover sheet coextensive with and covering the outer surface of said cover panel; said cover sheets joined about the periphery of the cover panel associated therewith, characterized in that:

at least one cover panel is provided with an interior opening positioned and sized so as not to impair substantially the structural integrity of said cover and into which opposing surfaces of said cover sheets are depressed together and joined so as to create a three-dimensional geometric cover design.

2. A binder according to claim 1 wherein said cover sheets are joined together by sealing in a region encompassing less than all of said opening so as to define slightly raised unsealed areas.

3. A binder according to claim 2; said cover panel being provided with a plurality of interior openings which collectively do not substantially impair the structural integrity of said cover and said cover sheets being sealed together in the regions of each of said openings.

4. A binder according to claim 3 wherein said cover sheets are heat sealed together in said region of sealing.

5. A binder according to claim 4 wherein said openings in said cover panel are formed by means of a die cut.

6. A binder according to claim 1 wherein said cover sheets are joined together by heat sealing in the region of said interior opening.

7. A binder according to claim 6 wherein there is a spine panel intermediate said front and rear covers, and hingedly connected thereto.

* * * * *